United States Patent [19]

Zack et al.

[11] 4,037,129

[45] July 19, 1977

[54] HIGH PRESSURE SODIUM VAPOR LAMP HAVING LOW STARTING VOLTAGE

[75] Inventors: Alexander T. Zack, Danvers; John J. Gutta, Salem, both of Mass.

[73] Assignee: GTE Sylvania Incorporated, Danvers, Mass.

[21] Appl. No.: 665,479

[22] Filed: Mar. 10, 1976

[51] Int. Cl.[2] ..... H01J 65/00

[52] U.S. Cl. ..... 313/201; 313/198; 313/229; 315/73

[58] Field of Search ..... 315/73; 313/198, 201

[56] References Cited

U.S. PATENT DOCUMENTS

| | | | |
|---|---|---|---|
| 3,721,845 | 3/1973 | Cohen et al. | 313/201 X |
| 3,900,753 | 8/1975 | Richardson | 313/201 X |

*Primary Examiner*—Rudolph V. Rolinec
*Assistant Examiner*—Darwin R. Hostetter
*Attorney, Agent, or Firm*—James Theodosopoulos

[57] ABSTRACT

The alumina arc tube of a high pressure sodium arc discharge lamp has a multiple turn wire starting aid wound therearound in order to reduce lamp starting voltage. The starting aid must extend longitudinally along the arc tube for a distance that is at least 10% of the arc length of the arc tube.

4 Claims, 1 Drawing Figure

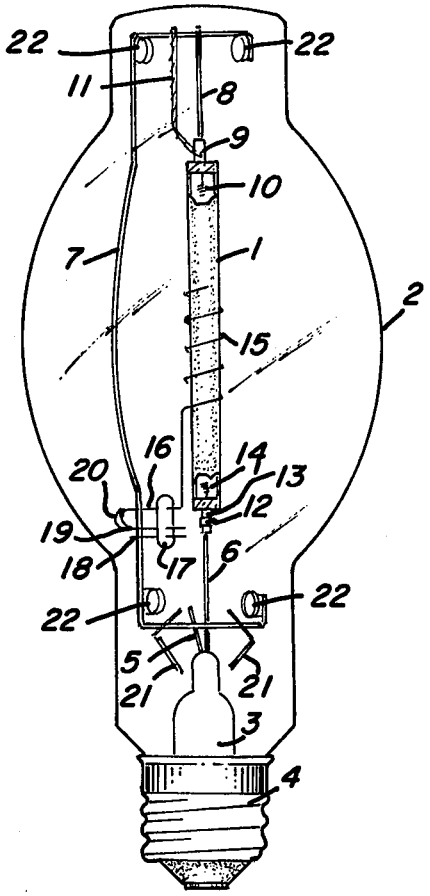
22
22
11
8
9
10
7
1
2
15
16
14
20
13
12
19
6
18
17
22
22
5
21
21
3
4

HIGH PRESSURE SODIUM VAPOR LAMP HAVING LOW STARTING VOLTAGE

THE INVENTION

This invention concerns high pressure sodium vapor arc discharge lamps of the type disclosed in U.S. Pat. No. 3,248,590. It is particularly concerned with such lamps having reduced starting voltage.

Examples of reduced starting voltage lamps are shown in U.S. Pats. Nos. 3,721,846, 3,746,914 3,757,158 3,757,159 3,806,747 and 3,806,748, which disclose that heating the arc tube reduces the starting voltage. In these patents the arc tubes are heated by means of a current-carrying heater wire wrapped around the arc tube.

Our invention is concerned with reduced starting voltage by the use of a capacitive starting aid such as is disclosed in U.S. Pats. Nos. 3,872,340 and 3,900,753. The starting aids disclosed therein comprise relatively narrow metal strips or wires in contact with or in close proximity to the outer surface of the arc tube. After lamp ignition, the starting aid is removed from physical contact with the arc tube, in one patent, and is electrically isolated in the other. The disclosure of U.S. Pat. Nos. 3,900,753 is incorporated herein by reference.

Our invention is concerned with a lamp having an improved starting aid. We have found that normal manufacturing variations in the pressure and composition of the gas filling of the arc tubes make it difficult to determine the optimum location for a prior art type of starting aid. We have also found that with prior art type starting aids, it is possible for a particular lamp to start at, say an applied voltage of 180 volts and yet not start at, say, 200 volts. It is the purpose of this invention to overcome these difficulties which occur with the relatively narrow prior art starting aids.

In a lamp in accordance with this invention, there is a multiple turn starting aid encircling the arc tube; moreover, the starting aid must extend longitudinally along the arc tube a distance that is at least 10 % of the arc length of the arc tube. The arc length is the distance between the electrodes at the ends of the lamp.

The single figure in the drawing is an elevational view, partly broken away, of a high pressure sodium arc discharge lamp in accordance with this invention.

A lamp in accordance with this invention, as shown in the drawing, comprises a hermetically sealed alumina arc tube 1 disposed within an outer glass jacket 2 which is sealed at the bottom to the flare of the usual stem press 3 and has the usual metal threaded base 4. Lead-in wires 5 and 6 are supported in stem press 3 and are connected to base 4 in the usual manner.

Support rod 7 is welded to lead-in wire 5 and extends roughly from the bottom to the top of the lamp. The upper end of arc tube 1 is supported by a rod 8 which is welded between support rod 7 and niobium tube 9. Tube 9 is sealed through the upper end of arc tube 1 and supports electrode 10 within arc tube 1. Electrical connection to electrode 10 is provided by metal strap 11 which is welded between rod 7 and niobium tube 9.

The lower end of arc tube 1 is supported by metal strap 12 which securely encircles lower niobium tube 13 and is welded to lead-in wire 6. Tube 13 is sealed through the lower end of arc tube 1 and supports electrode 14 within arc tube 1.

Encircling arc tube 1 is a multiple turn starting aid 15 made of refractory metal wire, such as tungsten or molybdenum. Starting aid 15 is welded to a support wire 16 which is embedded in a quartz rod 17. Quartz rod 17 is supported by another support wire 18 which is embedded thereon and is welded to support rod 7. Another wire 19 is embedded in quartz rod 17 and is also welded to rod 7. A U shaped bimetallic switch 20 is welded to wire 19 and makes pressure contact, at room temperature with wire 16. Thus, when the lamp is initially energized, starting aid 15 has the same voltage as electrode 10. Starting aid 15 is electrically removed from the circuit by the opening of switch 20, which occurs after a few seconds or minutes when switch 20 is heated to its actuating temperature, for example 105° C, by the heat generated by the lamp. Removal of starting aid 15 from the circuit is necessary in order to avoid electrolysis, during normal operation, which could draw sodium in the arc tube through the walls thereof.

Disposed at the lower end of the lamp, supported on rod 7, are two getters 21. Spring fingers 22, disposed at both ends of the lamp and mounted on rod 7, engage the inner wall of jacket 2 and aid in positioning arc tube 1.

Arc tube 1 contains sodium, mercury and a Penning mixture gaseous filling, for example, neon and argon.

In one example for a 150 watt lamp, starting aid 15 was made of 20 mil tungsten wire and consisted of 5 full turns wound at a pitch of about 1 turn per 5 mm. Thus, starting aid 15 extended longitudinally along arc tube 1 for a distance of about 25 mm, starting about 15 mm from electrode 14. The arc length of arc tube 1 was 80 mm and the arc tube diameter was 9 mm.

Lamps having starting aids in accordance with this invention started more consistently throughout the required starting voltage range than lamps having prior art starting aids.

We claim:

1. In a high pressure arc discharge lamp comprising an arc tube disposed within an outer jacket, the arc tube having an electrode at each end, the improvement which comprises a multiple turn wire starting aid coiled around the arc tube intermediate the electrodes and electrically connected to only one of the electrodes, the coiled starting aid extending longitudinally along the arc tube a distance that is at least 10 % of the arc length.

2. The lamp of claim 1 wherein the starting aid is made of tungsten or molybdenum wire.

3. The lamp of claim 1 wherein the arc tube has a fill including sodium, mercury and a Penning gas mixture.

4. The lamp of claim 1 wherein the starting aid is connected to said electrode through a temperature activated switch which is normally closed at room temperature and which is open during normal lamp operation.

* * * * *